US008806998B2

(12) United States Patent
Cappeller

(10) Patent No.: US 8,806,998 B2
(45) Date of Patent: Aug. 19, 2014

(54) GAS-OPERATED INTEGRATED PUNCHING DEVICE WITH PLATE PRESSER

(75) Inventor: Alessandro Cappeller, Tezze sul Brenta (IT)

(73) Assignee: Special Springs S.r.l., Rosa'—Vicenza (IT)

( * ) Notice: Subject to any disclaimer, the term of this patent is extended or adjusted under 35 U.S.C. 154(b) by 362 days.

(21) Appl. No.: 12/734,570

(22) PCT Filed: Nov. 13, 2008

(86) PCT No.: PCT/EP2008/065494

§ 371 (c)(1),
(2), (4) Date: May 10, 2010

(87) PCT Pub. No.: WO2009/063017

PCT Pub. Date: May 22, 2009

(65) Prior Publication Data

US 2010/0229706 A1 Sep. 16, 2010

(30) Foreign Application Priority Data

Nov. 13, 2007 (IT) ..... PD2007A0377

(51) Int. Cl.
*B21D 45/06* (2006.01)
*B21D 45/00* (2006.01)

(52) U.S. Cl.
CPC ..... *B21D 45/006* (2013.01)
USPC ..... 83/137; 83/698.91

(58) Field of Classification Search
USPC ..... 83/137, 138, 136, 698.91
See application file for complete search history.

(56) References Cited

U.S. PATENT DOCUMENTS

| | | | | |
|---|---|---|---|---|
| 2,586,695 | A * | 2/1952 | Mueller | 83/137 |
| 2,716,451 | A * | 8/1955 | Taylor | 83/137 |
| 2,983,176 | A | 5/1961 | Taylor | |
| 3,313,215 | A * | 4/1967 | Bieri | 92/86 |
| 4,292,869 | A | 10/1981 | Wallis | |

(Continued)

FOREIGN PATENT DOCUMENTS

ES 1010933 d4 3/1990

OTHER PUBLICATIONS

International ISO Standard I 1901-1—Second edition Dec. 1, 2003 (E1).
Brochure Azol Gas.

(Continued)

*Primary Examiner* — Stephen Choi
(74) *Attorney, Agent, or Firm* — Modiano & Associati; Albert Josif; Daniel J. O'Byrne

(57) ABSTRACT

A gas-operated integrated punching device with plate presser, including: a tubular containment body closed hermetically by a bottom and by a head that is perforated for the passage of a piston-operated plate presser moving within the tubular body; the plate presser being crossed coaxially by a punch connected to the tubular body; a compression and expansion chamber for loading pressurized gas being formed between the plate presser and the bottom such that the pressurized gas pushes the plate presser between a first fully extracted configuration with the outer end of the plate presser not in contact with a metal plate to be woked and protruding from the head by such a length as to affect the tip of the punch, and a second configuration at least partly retracted into the tubular body with the outer end of the plate presser in contact with a metal plate being worked.

18 Claims, 4 Drawing Sheets

(56) References Cited

U.S. PATENT DOCUMENTS

| | | | | |
|---|---|---|---|---|
| 4,316,399 | A | 2/1982 | Wallis | |
| 4,631,996 | A * | 12/1986 | Magnuson | 83/23 |
| 5,553,524 | A | 9/1996 | Fujita | |
| 5,662,016 | A | 9/1997 | Fujita | |
| 6,516,696 | B2 * | 2/2003 | Cotter | 83/588 |
| 2008/0105095 | A1 | 5/2008 | Ekman et al. | |

OTHER PUBLICATIONS

Brochure Bordignon.
Annex L page from the statement of claim, Jun. 2013.

* cited by examiner

GAS-OPERATED INTEGRATED PUNCHING DEVICE WITH PLATE PRESSER

The present invention relates to a gas-operated integrated punching device with plate presser.

BACKGROUND OF THE INVENTION

Punching or blanking operations, particularly for the mass-production of metallic components made of metal plate, for example for the automotive sector or for the electrical household appliance sector, generally use presses to the sliders of which one or more punching devices with plate pressers are applied, while corresponding dies are coupled to the fixed part of such presses; the metal plate to be worked is rested on such dies, and the punches, by descending, enter such dies in order to remove material.

A punching device with plate presser generally comprises a tubular containment body, which is closed by a bottom at one end and by a head at the opposite end; such head is perforated for the passage of a piston-operated plate presser, which performs a translational motion within such body and is crossed coaxially by a punch, a containment chamber for elastic pusher means for the plate presser is formed between such plate presser and such bottom.

In known punching devices with plate pressers, the elastic means are constituted either by a metallic helical spring or by an elastomeric element made of plastics.

Although these devices are widespread, they have drawbacks, the first of which is a pressing force generated by the plate presser on the metal plate that is insufficient to work so-called high-strength metal plates, i.e., with a very low thickness (for example between 0.2 and 0.5 mm) and made of high-strength steels, characterized by a tensile strength that is triple that of ordinary structural steels, and with mechanical properties that depend on phosphorus and manganese silicates, which are present in small quantities, and on the extremely low carbon content.

Helical springs, like elastomeric elements, in fact have a substantially linear compression curve, according to which the thrust force is zero if compression is nil; therefore, as the compressed helical spring (or elastomeric element) that pushes against the plate presser extends, i.e., when the punching device is lifted from the metal plate that it has just worked, the pressing force on the plate decreases, and does so in the most delicate situation, when the punch, lifted by the slider of the press, is made to exit from the punched metal plate, dragging with it the edges of the generated hole, with consequent unwanted deformation of such edge with respect to the desired flatness.

It is instead in this step that the plate presser in fact should express the maximum pressing force.

Further, in order to modify the pressing force of a plate presser, it is only possible to intervene by changing the entire punching device, since the tubular bodies of the various punching devices are designed to contain helical springs or elastomeric elements of very specific dimensions, which when compressed undergo deformations (i.e., expand diametrically) and therefore are not preset to contain elastic means of different dimensions to obtain different thrusts.

For elastomeric elements in particular, the compression length is limited, since the diametrical deformation is proportional to such compression length.

But it is the compression length of the spring that determines the maximum stroke of the punch in the metal plate, where the length of the stroke can be decisive in punching metal plates made of steels that are particularly designed to deform plastically and require a longer stroke than usual (for example if a stroke of 12-15 mm is needed but the obtainable stroke is 10 mm).

Further, plate pressers are currently provided which must be fitted on known types of punch holder pressing fixtures, so as to adapt to punches that are already commercially available, and can be fitted on the corresponding punch holding fixtures by way of reversible snap-acting or bayonet engagement means, which also are of the known type.

SUMMARY OF THE INVENTION

The aim of the present invention is to provide a gas-operated integrated punching device with plate presser that is capable of obviating the drawbacks revealed by similar devices of a known type.

Within this aim, an object of the present invention is to provide a gas-operated integrated punching device provided with a plate presser that is capable of a higher pressing force, at least when the punch is lifted, with respect to known devices.

Another object of the present invention is to provide a gas-operated integrated punching device with plate presser that allows to obtain longer punching strokes than known types of device.

Another object of the present invention is to provide a gas-operated integrated punching device with plate presser whose dimensions are comparable to those of known devices.

Another object of the present invention is to provide a gas-operated integrated punching device with plate presser that can be equipped also with known types of punch.

Another object of the invention is to provide a gas-operated integrated punching device with plate presser that can be fitted also on punching or blanking presses of a known type and already in operation.

Another object of the present invention is to provide a gas-operated integrated punching device with plate presser that can be manufactured with known systems and technologies.

This aim and these and other objects, which will become better apparent hereinafter, are achieved by a gas-operated integrated punching device with plate presser, characterized in that it comprises a tubular containment body that is closed hermetically at one end by a bottom and at the opposite end by a head that is perforated for the passage of a piston-operated plate presser, which performs a translational motion within said tubular body and is crossed coaxially by a punch that is jointly connected to said tubular body, a compression and expansion chamber for pressurized gas being formed between said plate presser and said bottom, said gas being loaded into said chamber by way of loading means inserted in said bottom or in said tubular body, the pressurized gas being designed to push said plate presser between two configurations, a first fully extracted configuration, in which the outer end of the plate presser is not in contact with a metal plate to be blanked or punched and protrudes from the head by such a length as to affect the tip of the punch, and a second configuration, which is at least partly retracted into the tubular body and in which the outer end of the plate presser is in contact with a metal plate being worked.

BRIEF DESCRIPTION OF THE DRAWINGS

Further characteristics and advantages of the invention will become better apparent from the following detailed description of three preferred but not exclusive embodiments thereof, illustrated by way of non-limiting example in the accompanying drawings, wherein.

DESCRIPTION OF THE PREFERRED EMBODIMENTS

Figure 1:
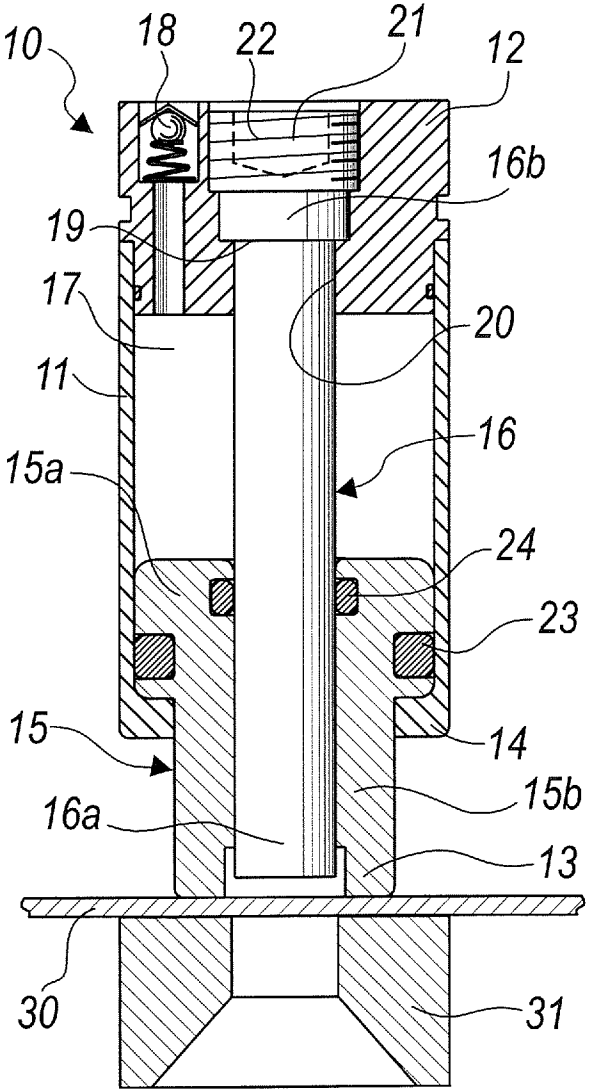
FIG. 1 is a sectional side view of a device according to the invention in a first embodiment thereof.

With reference to the figures, a gas-operated integrated punching device with plate presser according to the invention is generally designated by the reference numeral 10 in its first embodiment of FIG. 1.

The punching device 10 comprises a tubular containment body 11, which is closed hermetically at one end by a bottom 12 and at the opposite end by a head 14, which is perforated for the passage of a piston-operated plate presser 15.

The plate presser 15 is adapted to perform a translational motion within the tubular body 11.

The plate presser 15 is crossed coaxially by a punch 16, which is jointly connected to the bottom 12 and thus to the tubular body 11, which in turn is jointly connected to the bottom 12.

Between the plate presser 15 and the bottom 12 there is a compression and expansion chamber 17 for pressurized gas, which is loaded therein by way of loading means, of a known type already in use in spring-damper units, which are inserted in the bottom 12, as in the exemplary embodiments described here, or in the tubular body 11.

The pressurized gas, generally nitrogen, is intended to push the plate presser 15 between two configurations:

- a first fully extracted configuration, in which an outer end 13 of the plate presser 15 is not in contact with a metal plate 30 to be blanked or punched, and protrudes from the head 14 for such a length as to affect a tip 16*a* of the punch 16,
- and a second configuration, which is at least partly retracted into the tubular body 11 and in which the outer end 13 of the plate presser 15 is in contact with one metal plate 30 being worked.

In FIG. 1, the metal plate 30 is shown rested on a die 31, to be understood as being of a per se known type.

The loading means are constituted for example by a one-way valve 18 inserted in the bottom 12.

The punch 16, as mentioned, is jointly connected to the bottom 12 and is fixed to it by way of reversible fixing means.

Such reversible fixing means comprise an end face 16*b* of the punch 16 that has a larger cross-section than the punch body and has such a shape as to prevent its rotation; the end face 16*b* forms a shoulder designed to abut against a corresponding undercut 19 that is formed in a through hole 20 provided in the bottom 12 and crossed by the punch 16.

The end face 16*b* is locked in the hole 20 by way of reversible locking means.

Such reversible locking means consist of a threaded element 21, to be screwed into a corresponding complementarily threaded seat 22 that is formed at the inlet of the hole 20.

In an alternative embodiment of the invention, not shown for the sake of simplicity, the reversible fixing means are of the type with snap engagement, even of a per se known type.

The piston-operated plate presser 15 comprises a first annular part 15*a*, which lies inside the tubular body 11 and is contoured so as to slide therein, and a second part 15*b*, which also is annular and protrudes from the first part 15*a* and is designed to protrude from the head 14 until it surrounds the tip 16*a* of the punch 16 in the fully extracted configuration, as shown in FIG. 1.

The first part 15*a* supports external sealing means 23 for sliding on the internal surface of the tubular body 11 and internal sealing means 24 for axial sliding on the punch 16.

The sealing means 23 and 24 are constituted by elastic sealing rings, to be understood as being of a known type, or by other similar and equivalent elements.

Figure 2:
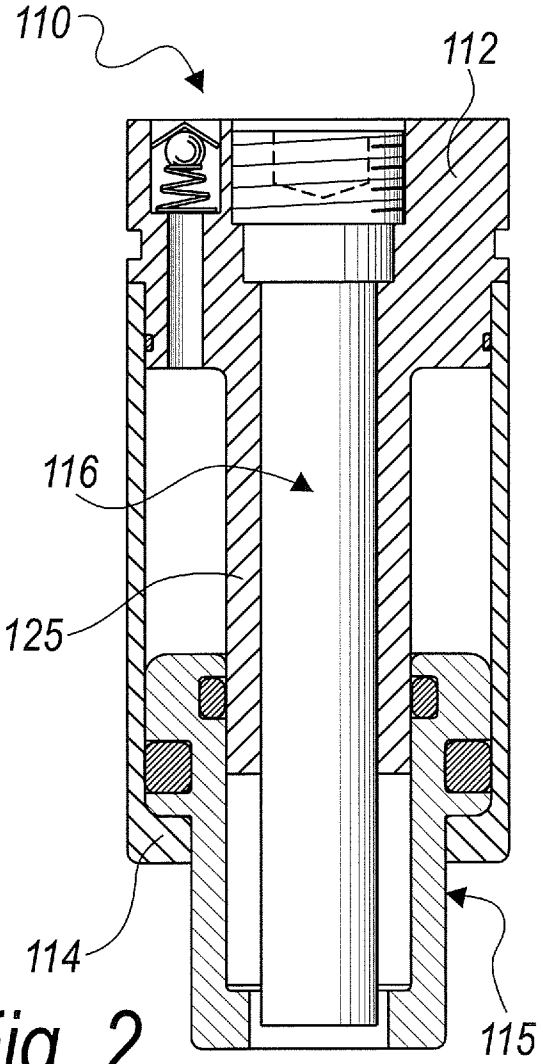
FIG. 2 is a sectional side view of the device according to the invention in a second embodiment thereof.

In a second embodiment of the device according to the invention, shown in FIG. 2 and designated therein by the reference numeral 110, a tubular guiding portion 125 for the plate presser 115 and for protecting the punch 116 extends toward the head 114 from the bottom 112.

In this embodiment, the plate presser 115 is shaped so as to slide thereon instead of sliding directly on the punch 116 as in the first embodiment.

This second embodiment of the device 110 according to the invention allows to replace the punch 116 without discharging the gas from the chamber 17 of the device 110.

Figure 3:
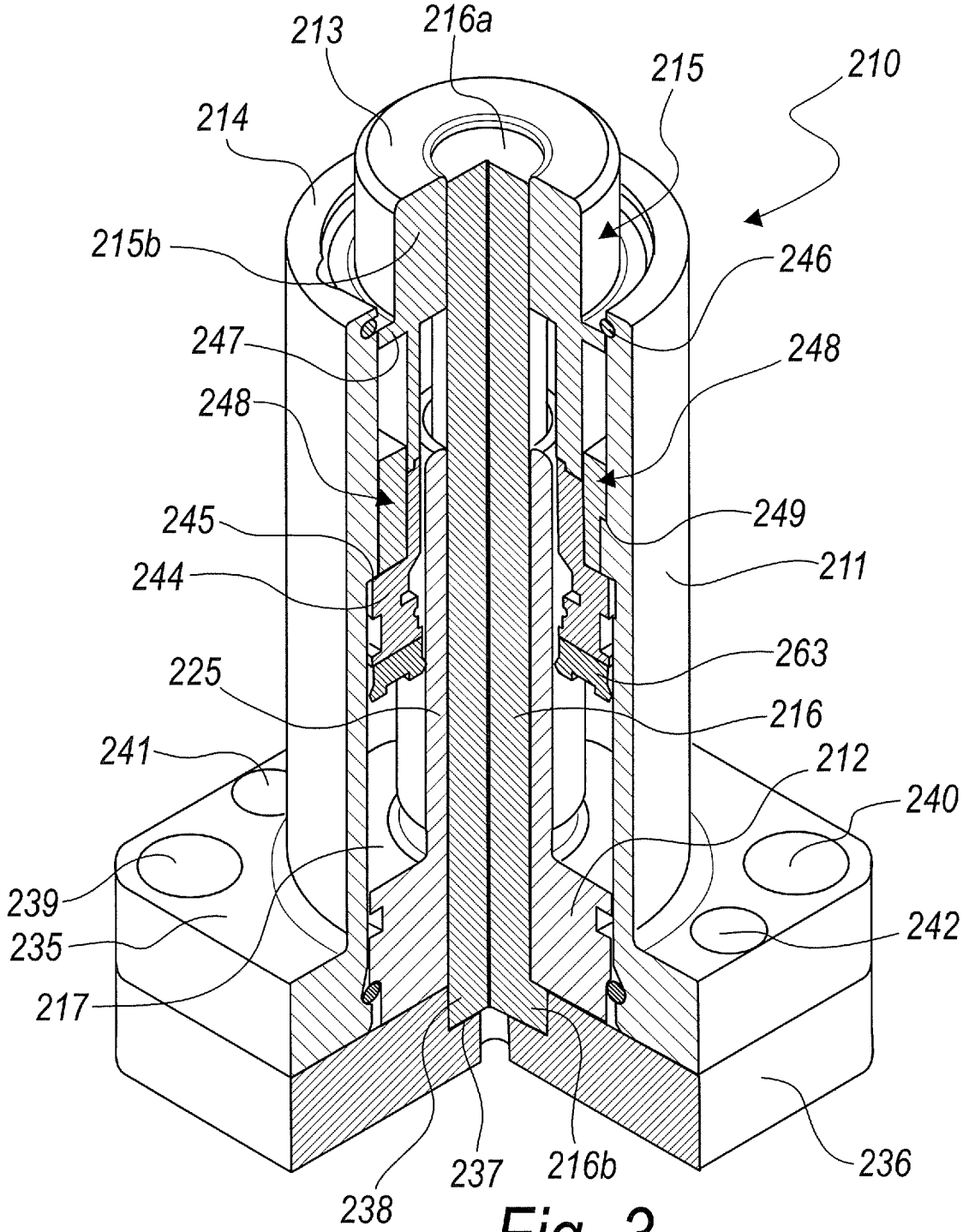
FIG. 3 is a cutout perspective view of the device according to the invention in a third embodiment thereof.
Figure 4:
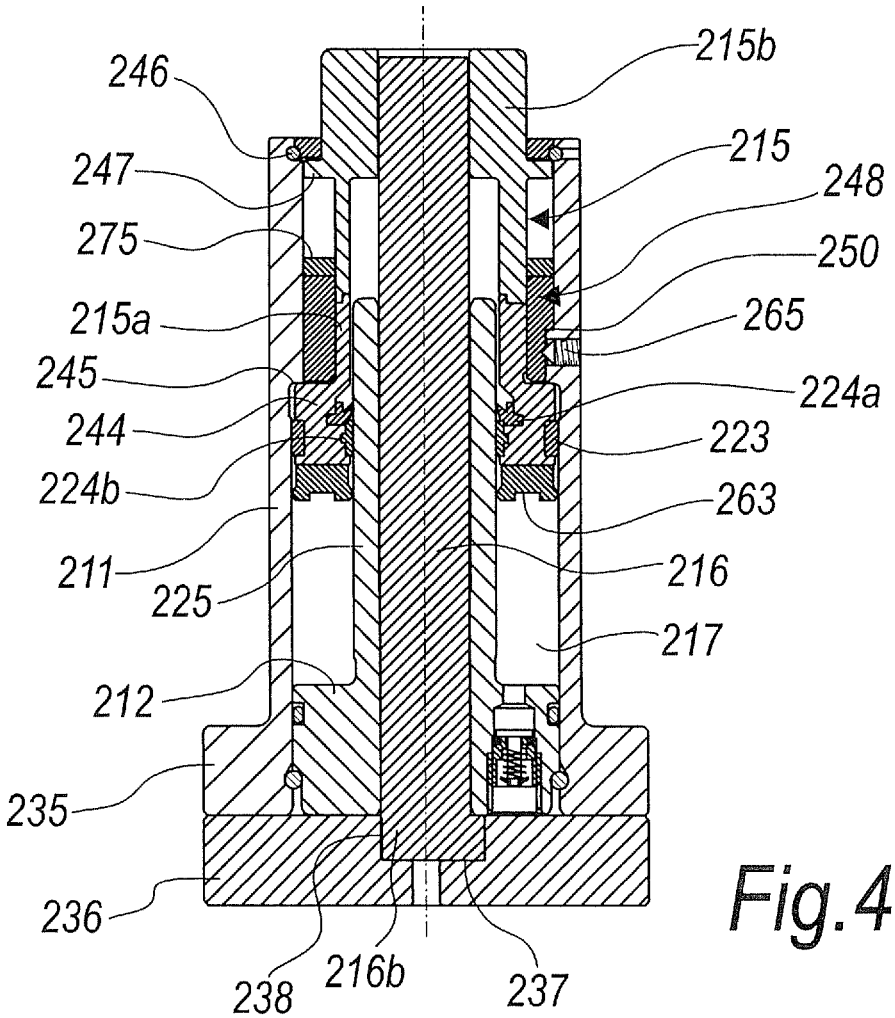
FIG. 4 is a sectional side view of the device according to the invention in its third embodiment of FIG. 3.
Figure 5:
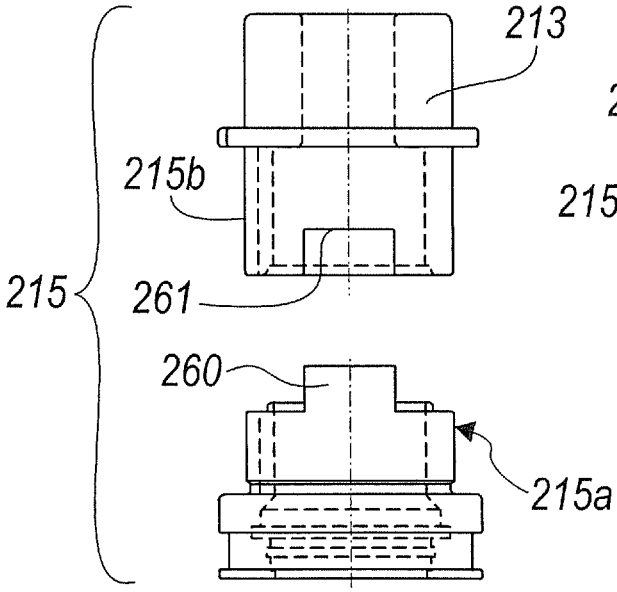
FIGS. 5 and 6 are views of a particular detail of the device according to the invention in its third embodiment of FIGS. 3 and 4.
Figure 6:
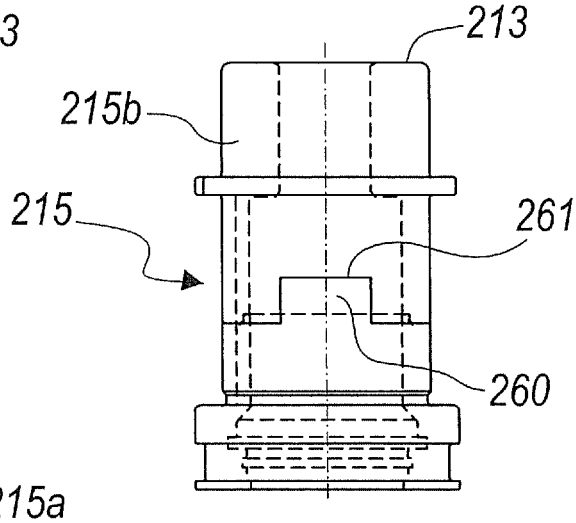

A third embodiment is shown in FIGS. 3 and 4.

The third embodiment of the device according to the invention, designated by the reference numeral 210, comprises a tubular containment body 211, with a bottom 212 and a head 214, which is perforated for the passage of a piston-operated plate presser 215; the plate presser 215 can slide on a tubular portion 225 for guiding the plate presser 215 and for protecting a punch 216; the plate presser 215 and the tubular portion 225 are indeed crossed by the punch 216.

In this third embodiment of the invention, a base flange 235 extends from the tubular containment body 211.

The bottom 212 and the tubular portion 225 are monolithic.

The punch 216 is fixed to the bottom 212 and to the tubular body 211 by way of its end face 216*b*, which has a larger diameter than the rest of the body of the punch 216 and is locked between the bottom 212 and a closure plate 236, to be arranged so as to face the flange 235.

The closure plate 236 is contoured so as to affect the flange 235 and has a receptacle 237 which is shaped complementarily with respect to the end face 216*b* of the punch and is adapted to contain it.

The end face 216*b* has a rotation-preventing flat portion 238, optionally also for punches that are known and commercially available.

The flange 235 and the closure plate 236 have corresponding first holes 239, 240 for screws for fixing to a plate pressing fixture and second holes 241 and 242 for positioning and centering pins.

In this third embodiment of the device 210 according to the invention, the piston-operated plate presser 215 is constituted by two separate parts:

- a first annular part 215*a*, which is internal to the tubular body 211 and is contoured to slide therein and has an annular abutment portion 244 for stopping during ascent against an extraction-preventing shoulder 245 formed on the internal face of the tubular body 211;

and a second annular part 215*b*, which is axially adjacent to the first part 215*a* and is designed to protrude from the head 214 so as to surround the tip 216*a* of the punch 216 in the fully extracted configuration.

The second annular part 215*b* is retained within the tubular body 211 by a stop ring 246, which is inserted in the head 214 of the tubular body 211 and is adapted to receive by abutment a corresponding shoulder 247 that expands radially from the second annular part 215*b*.

This embodiment allows, by removing the stop ring 246, to extract the second annular part 215*b* without discharging the gas from the chamber 217, so as to be able to shape the end 213 of the second annular part 215*b* or replace the second annular part 215*b* of the plate presser 215 with another one whose end 213 is shaped differently, depending on the shape and profile of the plate to be punched.

Figure 7:
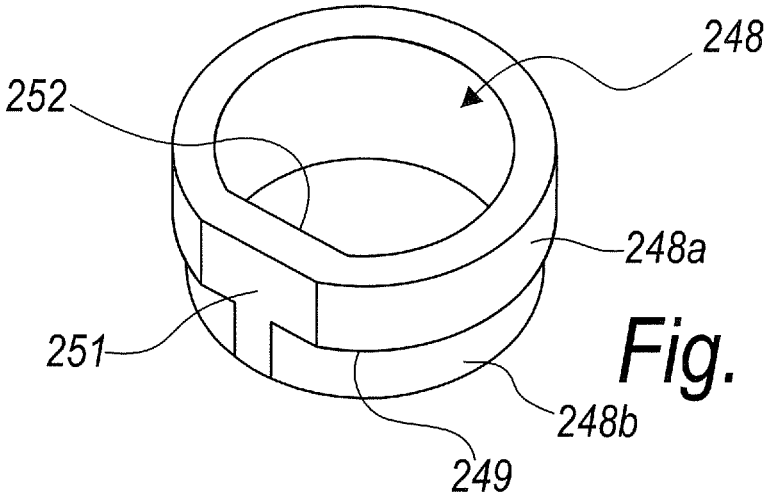
FIG. 7 is a view of another detail of the device according to the invention in its third embodiment.

The plate presser 215, within the tubular body 211, between the head 214 and the annular portion 244, is surrounded by a rotation-preventing guiding and lubrication band 248, which is shown in FIGS. 3, 4 and 7.

The rotation-preventing band 248 comprises an annular portion 248*a* that has a larger diameter and a portion 248*b* that has a smaller diameter; the portions 248*a* and 248*b* form a positioning abutment 249 for abutment against a corresponding shoulder 250 formed within the tubular body 211.

The rotation-preventing band 248 also has a double rotation-preventing flat region, designated in the figures by the reference numerals 251 for the outer flat region and 252 for the internal flat region.

The rotation-preventing band 248 is made of self-lubricating material.

The rotation-preventing band 248 is obtained preferably by molding, but it is understood that it can be obtained also by means of other processes and production methods.

The two flat regions 251 and 252 prevent the rotation of the plate presser 215 with respect to the tubular body 211 and the punch 216.

The rotation-preventing band 248 is locked to the tubular containment body 211 by way of one or more grub screws 265, which are screwed radially through the body 211 until they press against the rotation-preventing band 248; the rotation-preventing band 248 is to be understood as being lockable also by way of other similar and equivalent means and devices.

The first part 215*a* and the second part 215*b* of the plate presser 215 also are associated with each other by way of means adapted to prevent mutual rotation.

In this third embodiment of the invention, such means adapted to prevent the mutual rotation of the two parts 215*a* and 215*b* of the plate presser are constituted by at least one tab 260, which protrudes from one of the two parts toward the other one, in this case the first part 215*a*, and is adapted to enter a corresponding complementarily shaped slot 261 formed on the other part, in this case the second part 215*b*.

The first part 215*a* bears external sealing and guiding means 223 for sliding on the internal surface of the tubular body 211 and internal sealing and guiding means 224*a* and 224*b* for coaxial sliding on the tubular portion 225.

The external sealing and guiding means 223 are constituted by a first annular guiding band, the internal sealing and guiding means 224*a* are constituted by an internal scraper ring, the internal sealing and guiding means 224*b* are constituted by a second annular guiding band.

The first part 215*a* of the plate presser 215 has, within the chamber 217, also an elastic sealing ring 263, which is contoured to adhere both to the tubular containment body 211 and to the tubular guiding portion 225 for the plate presser 215.

Above the rotation-preventing band 248 there is a scraper ring 275 for protecting the band 248.

Figure 8:
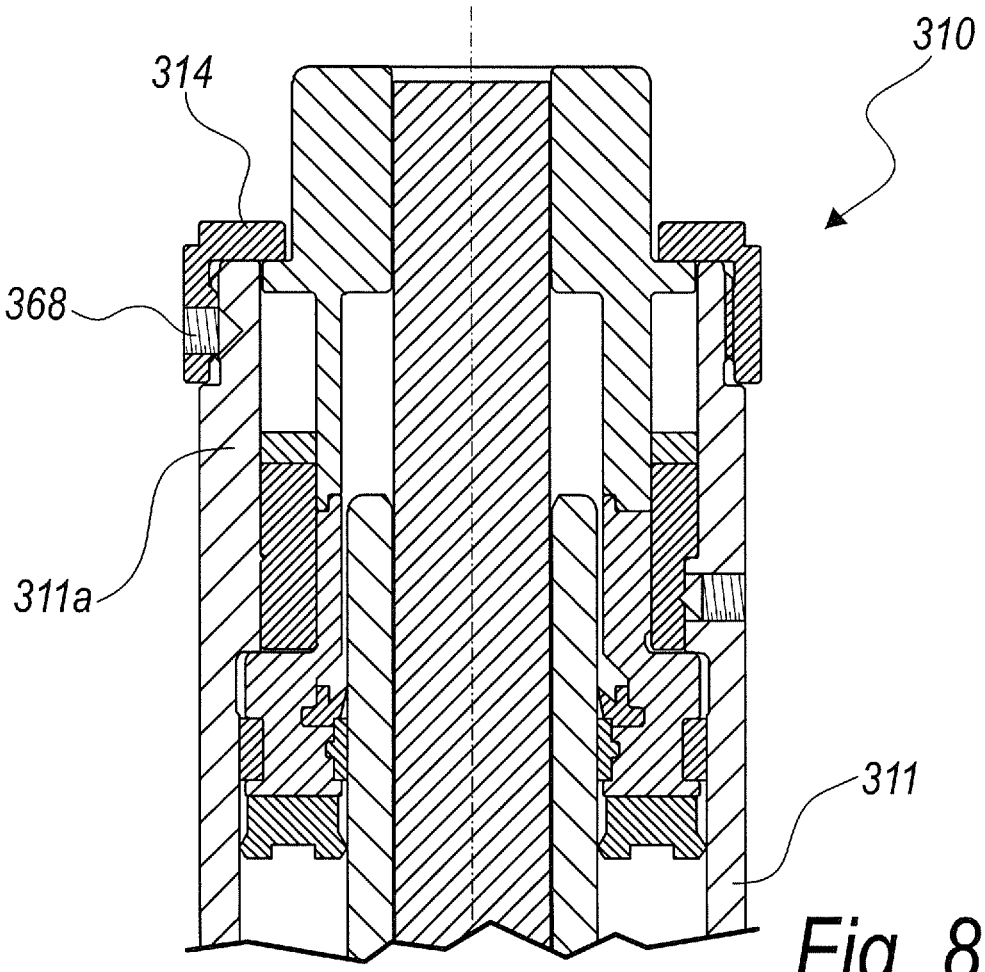
FIG. 8 is a view of a variation of the third embodiment of the device according to the invention.

In a variation of this third embodiment, shown in FIG. 8 and designated by the reference numeral 310 therein, the head 314 of the tubular body 311 is constituted by an annular cover, which is fixed reversibly to the cylindrical jacket 311*a* of the tubular body 311 by way of one or more radial grub screws 368.

The operation of the punching device 10, 110 and 210 according to the invention is fully similar to the operation of known types of punching device.

The expected advantages are achieved by using pressurized gas, whose thrust, as occurs with ordinary spring-damper units, allows to obtain a compression curve (diagram of force as a function of compression) that has a much lower gradient than the typical compression curves of helical springs or of the elastomeric elements that are typically used.

This entails that the punching device 10, 110 and 210 according to the invention ensures greater thrust, with respect to known devices, during the steps for approach to the metal plate 30 and for lifting away from it, on the part of the plate presser 15, 115 and 215.

In fact, while known devices in these steps have the helical spring or the elastomeric element practically fully extended or simply preloaded, and therefore capable of minimal thrust, the punching device 10, 110 and 210 according to the invention is capable of ensuring that the plate presser 15, 115 and 215 has a pressing force that is adequate and proportional to the pressure with which the gas is loaded initially into the chamber 17 and 217.

The higher the loading pressure of the gas in the device 10, 110, 210 and 310, the greater the minimum pressing force of which the plate presser 15, 115 and 215 is capable.

In practice it has been found that the invention thus conceived solves the intended aim and objects.

In particular, a gas-operated integrated punching device with plate presser is provided which is equipped with a plate presser that is capable of a higher pressing force, at least during punch lifting, with respect to known devices, particularly for equal dimensions.

Further, a gas-operated integrated punching device has been provided which allows to obtain longer punching strokes than known types of device, by way of the compressibility of the gas, which obviates the limitations set by the diametrical expansion for the elastomeric elements and by the packing of coils in an axial direction of the helical springs.

Moreover, a punching device has been devised which can be provided with dimensions that are comparable to those of known devices.

Moreover, a punching device is provided which can be equipped also with known types of punch.

Moreover, differently from what is known, such integrated punching device with plate presser allows the buyer to have at his disposal a device that is complete and immediately applicable, differently from the background art, which proposes plate pressers that must be fitted on punch holder pressing fixtures also of a known type, so as to adapt to punches that are already commercially available and can be fitted on the corresponding punch holder fixtures by way of appropriately provided engagement means, also of a known type.

Of course, a punching device is provided which can also be fitted on known types of punching or blanking press that are already in operation.

Not least, a gas-operated integrated punching device is provided which has plate presser that can be manufactured with known systems and technologies.

The invention thus conceived is susceptible of numerous modifications and variations, all of which are within the scope of the appended claims; all the details may further be replaced with other technically equivalent elements.

In practice, the materials employed, so long as they are compatible with the specific use, as well as the dimensions, may be any according to requirements and to the state of the art.

The disclosures in Italian Patent Application No. PD2007A000377 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

What is claimed is:

1. A gas-operated integrated punching device with plate presser, comprising a tubular containment body that is closed hermetically at a first end by a bottom and at a second end arranged opposite said first end by a head that is perforated for a passage of a piston-operated plate presser capable of moving with a translational motion within said tubular body, said plate presser being crossed coaxially by a punch, which is jointly connected to said tubular body, a compression and expansion chamber for pressurized gas being formed between said plate presser and said bottom whereby the pressurized gas pushing said plate presser between two configurations comprising a first fully extracted configuration, in which an outer end of the plate presser protrudes from the head by a fully extracted length, and a second retracted configuration in which said plate presser is at least partly retracted into the tubular body with respect to said first fully extracted configuration, said gas being loaded into said chamber by way of a loading element inserted in said bottom or in said tubular body, and the punching device further comprising a tubular guiding portion for the plate presser and for protecting said punch, said punch being reversibly jointly connected to said bottom and said tubular guiding portion being arranged extending in a direction from said bottom toward the head such that said punch is slidingly removably arranged inside said tubular guiding portion, the plate presser being slidingly arranged on said tubular guiding portion between said first fully extracted configuration and said second retracted configuration, in a sealed manner provided by an internal guiding seal arranged between said plate presser and said tubular guiding portion, and provided by an external guiding seal arranged between said plate presser and an internal surface of said tubular body, such that said punch is selectively replaceable by sliding inside said tabular guiding portion at any configuration of said plate presser comprised between said first fully extracted configuration and said second retracted configuration without discharging the pressurized gas from said compression and expansion chamber.

2. The device according to claim 1, wherein said loading element is constituted by a one-way valve inserted in the bottom.

3. The device according to claim 1, wherein said piston-operated plate presser comprises a first annular part, which lies inside the tubular body and is contoured so as to slide therein, and a second part, which is also annular, extends from the first part and protrudes from said head and surrounds a tip of the punch in the fully extracted configuration, said first part carrying said external guiding seal for sliding on an internal surface of the tubular body, and said internal guiding seal for coaxial sliding on the punch.

4. The device according to claim 1, wherein said head of the tubular body is constituted by an annular cover, which is fixed reversibly to a cylindrical jacket of the tubular body by way of one or more radial grub screws.

5. A gas-operated integrated punching device with plate presser, comprising a tubular containment body that is closed hermetically at a first end by a bottom and at a second end arranged opposite said first end by a head that is perforated for a passage of a piston-operated plate presser capable of moving with a translational motion within said tubular body, said plate presser being crossed coaxially by a punch, which is jointly connected to said tubular body, a compression and expansion chamber for pressurized gas being formed between said plate presser and said bottom whereby the pressurized gas pushing said plate presser between two configurations comprising a first fully extracted configuration, in which an outer end of the plate presser protrudes from the head by a fully extracted length, and a second retracted configuration in which said plate presser is at least partly retracted into the tubular body with respect to said first fully extracted configuration, said gas being loaded into said chamber by way of a loading element inserted in said bottom or in said tubular body, and the punching device further comprising a tubular guiding portion for the plate presser and for protecting said punch, said punch being reversibly jointly connected to said bottom and said tubular guiding portion being arranged extending in a direction from said bottom toward the head such that said punch is slidingly removably arranged inside said tubular guiding portion, the plate presser being slidingly arranged on said tubular guiding portion between said first fully extracted configuration and said second retracted configuration, in a sealed manner provided by an internal guiding seal arranged between said plate presser and said tubular guiding potion, and provided by an external guiding seal arranged between said plate presser and an internal surface of said tubular body, such that said punch is selectively replaceable by sliding inside said tubular guiding portion at any configuration of said plate presser comprised between said first fully extracted configuration and said second retracted configuration without discharging the pressurized gas from said compression and expansion chamber, wherein said punch is jointly connected to the bottom and is fixed thereto by way of reversible fixing means.

6. The device according to claim 5, wherein said reversible fixing means comprise an end face of the punch having a configuration for preventing rotation of the punch and having a larger cross-section than a body of the punch, said end face forming a shoulder arranged in abutment against a corresponding undercut formed in a through hole provided in the bottom and crossed by said punch, said end face being locked in said hole by reversible locking means.

7. The device according to claim 6, wherein said reversible locking means comprise a threaded element screwed into a corresponding complementarily threaded seat formed at an inlet of said hole.

8. The device according to claim 5, wherein said reversible fixing means comprise snap-acting engagement elements.

9. A gas-operated integrated punching device with plate presser, comprising a tubular containment body that is closed hermetically at a first end by a bottom and at a second end arranged opposite said first end by a head that is perforated for a passage of a piston-operated plate presser capable of moving with a translational motion within said tubular body, said plate presser being crossed coaxially by a punch, which is jointly connected to said tubular body, a compression and expansion chamber for pressurized gas being formed between said plate presser and said bottom whereby the pressurized gas pushing said plate presser between two configurations comprising a first fully extracted configuration, in which an outer end of the plate presser protrudes from the head by a fully extracted length, and a second retracted configuration in which said plate presser is at least partly retracted into the tubular body with respect to said first fully extracted configuration, said gas being loaded into said chamber by way of a loading element inserted in said bottom or in said tubular body, and the punching device further comprising a tubular guiding portion for the plate presser and for protecting said punch, said punch being reversibly jointly connected to said bottom and said tubular guiding portion being arranged extending in a direction from said bottom, toward the head such that said punch is slidingly removably arranged inside said tubular guiding portion, the plate presser being slidingly arranged on said tubular guiding portion between said first fully extracted configuration and said second retracted configuration, in a sealed manner provided by an internal guiding seal arranged between said plate presser and said tubular guiding portion, and provided by an external guiding seal arranged between said plate presser and an internal surface of said tubular body, such that said punch is selectively replaceable by sliding inside said tubular guiding portion at any configuration of said plate presser comprised between said first fully extracted configuration and said second retracted configuration without discharging the pressurized gas from said compression and expansion chamber, the device further comprising a base flange expanding from said tubular containment body, said punch being fixed to the bottom and to the tubular body by way of an end face thereof that has a larger diameter than a body of the punch, said end face being locked between said bottom and a closure plate, arranged facing said base flange.

10. The device according to claim 9, wherein said closure plate has a receptacle that is complementarily shaped with respect to the end face of the punch and is adapted to contain said end face.

11. The device according to claim 9, wherein said end face has a rotation-preventing flat region.

12. The device according to claim 9, wherein said flange and said closure plate have corresponding first holes for screws for fixing to a plate pressing fixture, and second holes for positioning and centering pins.

13. The device according to claim 9, wherein said piston-operated plate presser is constituted by two separate parts comprising:

a first annular part, which is internal to the tubular body and is contoured to slide therein and which has an annular abutment portion for stopping during ascent against an extraction-preventing shoulder formed on an internal face of the tubular body; and a second annular part, which is arranged axially adjacent to the first part and which protrudes from the head so as to surround a tip of the punch in the fully extracted configuration.

14. The device according to claim 13, wherein said second annular part is retained within the tubular body by a stop ring, which is inserted in the head of the tubular body and is adapted to receive by abutment a corresponding shoulder that expands radially from the second annular part.

15. The device according to claim 14, wherein said stop ring is removably arranged in order to extract the second annular part of the plate presser.

16. The device according to claim 13, wherein said plate presser, within the tubular body, between the head and the annular abutment portion, is surrounded by a rotation-preventing guiding and lubrication band, which has a double flat region adapted to prevent the rotation of the plate presser with respect to the tubular body and the punch.

17. The device according to claim 13, wherein said first annular part bears said external guiding seal for sliding on the internal surface of the tubular body and said internal guiding seal for coaxial sliding on the tubular portion.

18. The device according to claim 13, wherein said first part of the plate presser has, within said chamber, also an elastic sealing ring, which is contoured to adhere both to the tubular containment body and to the tubular guiding portion for the plate presser.

* * * * *